US009038740B2

(12) United States Patent
Lende et al.

(10) Patent No.: US 9,038,740 B2
(45) Date of Patent: May 26, 2015

(54) APPARATUS AND METHOD OF FORMING A PLUG IN A WELLBORE

(75) Inventors: Gunnar Lende, Sola (NO); Hank Rogers, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 826 days.

(21) Appl. No.: 13/290,219

(22) Filed: Nov. 7, 2011

(65) Prior Publication Data

US 2013/0112434 A1 May 9, 2013

(51) Int. Cl.

| | |
|---|---|
| ***E21B 33/134*** | (2006.01) |
| ***E21B 33/16*** | (2006.01) |
| ***E21B 47/00*** | (2012.01) |
| ***E21B 17/06*** | (2006.01) |

(52) U.S. Cl.

CPC ..... *E21B 33/16* (2013.01); *E21B 33/134* (2013.01); *E21B 47/0005* (2013.01); *E21B 17/06* (2013.01)

(58) Field of Classification Search

None

See application file for complete search history.

(56) References Cited

U.S. PATENT DOCUMENTS

| | | | | |
|---|---|---|---|---|
| 2,316,402 | A * | 4/1943 | Canon | 166/140 |
| 3,385,367 | A | 5/1968 | Kollsman | |
| 5,488,994 | A | 2/1996 | Laurel et al. | |
| 5,566,757 | A | 10/1996 | Carpenter et al. | |
| 5,718,292 | A | 2/1998 | Heathman et al. | |
| 6,772,835 | B2 | 8/2004 | Rogers et al. | |
| 7,059,415 | B2 | 6/2006 | Bosma et al. | |
| 7,143,832 | B2 | 12/2006 | Freyer | |
| 7,234,533 | B2 | 6/2007 | Gambier | |
| 7,472,752 | B2 | 1/2009 | Rogers et al. | |
| 7,681,653 | B2 | 3/2010 | Korte et al. | |
| 7,823,649 | B2 | 11/2010 | Brown et al. | |
| 2004/0040709 | A1 * | 3/2004 | Rogers et al. | 166/285 |
| 2007/0062694 | A1 * | 3/2007 | Ring et al. | 166/250.08 |
| 2007/0163783 | A1 * | 7/2007 | Head | 166/368 |
| 2010/0307773 | A1 | 12/2010 | Tinnen et al. | |
| 2010/0307774 | A1 | 12/2010 | Tinnen | |
| 2011/0214863 | A1 | 9/2011 | Hinkie | |

OTHER PUBLICATIONS

Rogers et al., Drillable Tailpipe Disconnect: Used Successfully in More Than 120 Wells Worldwide, Sep. 24-27, 2006, Society of Petroleum Engineers, SPE 102534.*

IP.com Prior ArtDatabase, "Instant Packer Using Swell Rubber", IP.com number: IPCOM000200462D, Oct. 14, 2010.

IP.com Prior ArtDatabase, "Swellable packers to automatically choke or shut of flow in a wellbore", IP.com number: IPCOM000202172D, Dec. 7, 2010.

* cited by examiner

*Primary Examiner* — Jennifer H Gay

*Assistant Examiner* — Caroline Butcher

(74) *Attorney, Agent, or Firm* — John W. Wustenberg; Baker Botts L.L.P.

(57) ABSTRACT

A method of forming a plug in a wellbore includes disposing a work string in a wellbore. The work string includes a first tool comprising a port providing fluid communication between an interior space of the first tool to an exterior space to permit placement of a plug in a wellbore. The method includes introducing a first fluid volume via the work string to form a plug in the wellbore, and includes load testing the plug at least in part by applying an axial force on the plug with the work string to determine that the plug is set.

15 Claims, 6 Drawing Sheets

APPARATUS AND METHOD OF FORMING A PLUG IN A WELLBORE

BACKGROUND

The present disclosure relates generally to wellbore operations and, more particularly, to an apparatus and method of forming a plug in a wellbore.

When drilling a wellbore which penetrates one or more subterranean earth formations, it is often advantageous or necessary to form a hardened plug in the wellbore. Such plugs are used for many reasons, including abandonment of the well, wellbore isolation, wellbore stability, or kick-off procedures. Typically, a cement plug may be set in a borehole by pumping a volume of cement slurry into the workstring. The cement slurry travels down the workstring and exits into the wellbore to form the plug. The cement slurry typically exits through one or more openings located at or near the end of the workstring. After placement of the cement slurry, the work string is pulled out of the cement plug.

At this point, in case of a plug verification requirement, a conventional operational method requires waiting for the cement to set, and then using the workstring to contact the hard cement plug with enough force to verify the presence of the plug, as well as the location of the top of the plug. The necessary wait time typically is substantial. For example, the operation duration of a typical job may require a cement fluid time in the range of about four (4) to six (6) hours, which may translate to a wait-on-cement (WOC) time of about twelve (12) to twenty-four (24) hours. The total time required, of course, will increase with the number of plugs involved in the job.

Therefore, what is needed is an apparatus and method for forming plugs in a wellbore that improves plug formation operations and decreases the amount of time required.

SUMMARY

The present disclosure relates generally to wellbore operations and, more particularly, to an apparatus and method of forming a plug in a wellbore.

In one aspect, a method of forming a plug in a wellbore is disclosed. The method may include disposing a work string in a wellbore. The work string may include a first tool comprising a port providing fluid communication between an interior space of the first tool to an exterior space to permit placement of a plug in a wellbore. The method may further include introducing a first fluid volume via the work string to form a plug in the wellbore, and load testing the plug at least in part by applying an axial force on the plug with the work string to determine that the plug is set.

In another aspect, an apparatus to form a plug in a wellbore is disclosed. The apparatus may include a work string that includes a first tubular section. The work string may further include a disconnect tool coupling the first tubular section to a first tool so that the first tubular section and the first tool are in fluid communication via the disconnect tool. The disconnect tool may be configured to allow selective decoupling of the first tubular section and the first tool. The first tool may include a port providing fluid communication between an interior space of the first tool to an exterior space to permit placement of a plug in a wellbore. The work string may further include a rupture element assembly configured to indicate an upper extent of the plug in the wellbore. The work string may be configured to permit load testing the plug at least in part by applying an axial force on the plug with the work string to determine that the plug is set.

Accordingly, certain embodiments according to the present disclosure may allow for significant time savings, as compared to conventional operations, by eliminating the need for physically tagging a plug with a work string by applying weight from above. Certain embodiments provide for the use of the string to physically load test the plug in the most appropriate direction, namely upwards, with a pull test. Certain embodiments allow for optimized means of determining a plug TOC (top of cement) after the plug has been set in a wellbore.

The features and advantages of the present disclosure will be readily apparent to those skilled in the art. While numerous changes may be made by those skilled in the art, such changes are within the spirit of the disclosure.

BRIEF DESCRIPTION OF THE DRAWINGS

Some specific exemplary embodiments of the disclosure may be understood by referring, in part, to the following description and the accompanying drawings.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to wellbore operations and, more particularly, to an apparatus and method of forming a plug in a wellbore.

Illustrative embodiments of the present disclosure are described in detail herein. In the interest of clarity, not all features of an actual implementation may be described in this specification. It will of course be appreciated that in the development of any such actual embodiment, numerous implementation specific decisions must be made to achieve the specific implementation goals, which will vary from one implementation to another. Moreover, it will be appreciated that such a development effort might be complex and time consuming, but would nevertheless be a routine undertaking for those of ordinary skill in the art having the benefit of the present disclosure.

To facilitate a better understanding of the present disclosure, the following examples of certain embodiments are given. In no way should the following examples be read to limit, or define, the scope of the disclosure. Embodiments of the present disclosure may be applicable to horizontal, vertical, deviated, or otherwise nonlinear wellbores in any type of subterranean formation. Embodiments may be applicable to injection wells as well as production wells, including hydrocarbon wells.

Certain embodiments of the present disclose provide for the use of a work string after it is cemented in place to physically load test the plug in the upward direction with a pull test. The upward direction provides an appropriate simulation of the forces that the plug would bear, and knowledge of the pulling force and the travel/stretch of the string may be used to calculate the position of the plug. The pulling force may include an axial force directed up the wellbore. Alternatively or in addition, load testing in the downward direction may be performed, with an axial force directed down the wellbore. Additionally, certain embodiments provide for the use of rupture elements that allows determination of the location of a plug TOC (top of cement) in relation to the rupture elements which have known locations in the wellbore. Certain embodiments may provide for the use of a free pipe locator tool to get an exact free pipe location.

Figure 1A:
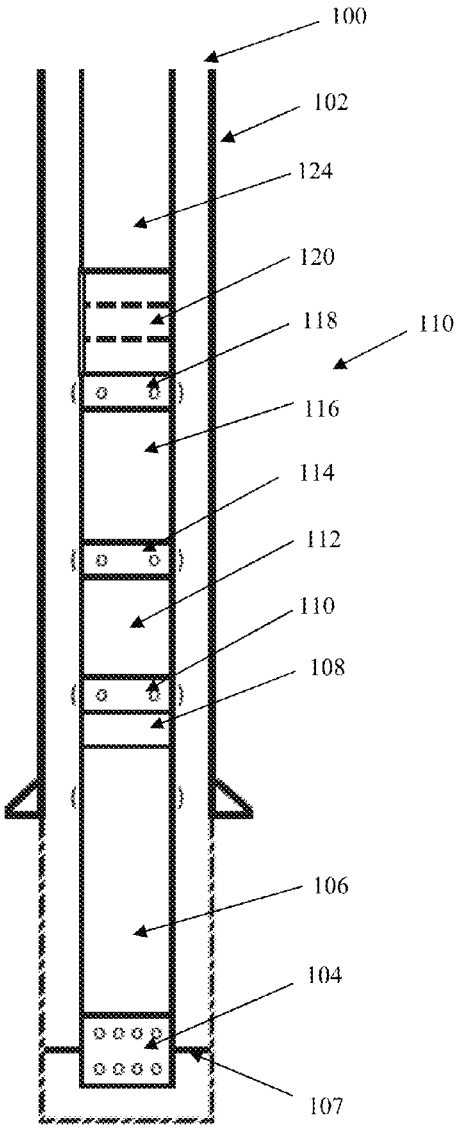
FIGS. 1A and 1B are diagrams of work strings in a well bore, in accordance with certain embodiments of the present disclosure.
Figure 1B:
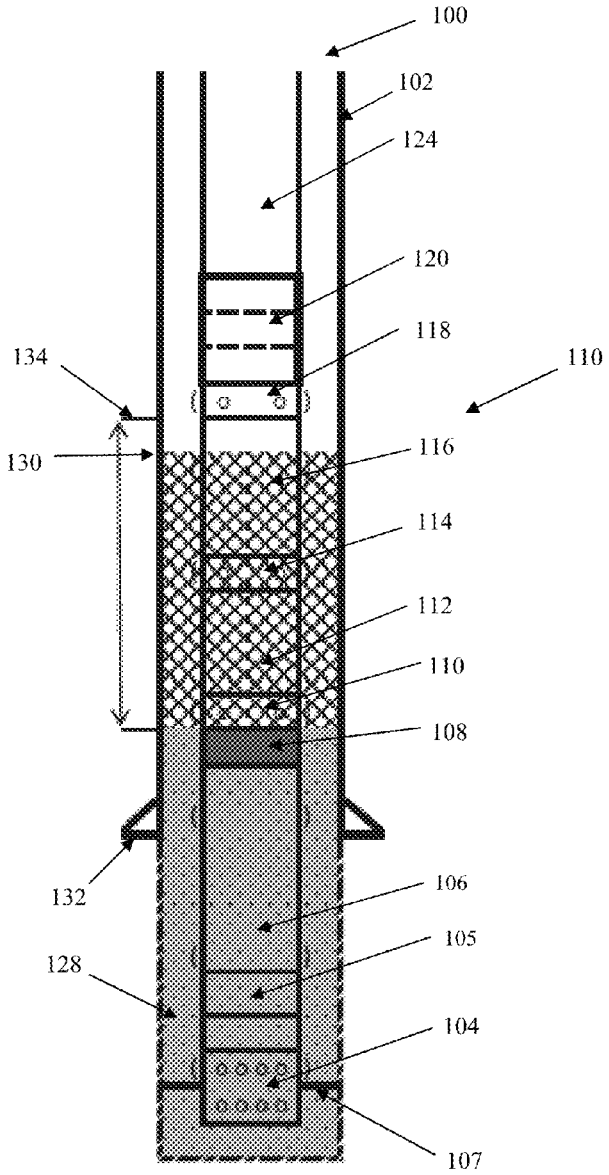

FIGS. 1A and 1B are diagrams of work strings in a well bore, in accordance with certain embodiments of the present disclosure. The work strings may allow use of what is referred to as "hot" cement slurries, because the required thickening times are extremely short relative to those of other cement slurries. Time requirements are short because main requirements are for mixing, pumping and displacement. No time is necessary for pulling out or circulating above a plug.

A work string 100 is shown as located in a wellbore 102, which may be open hole or cased hole. The work string 100 may include a series of coupled tubular members coupled in any conventional manner. By way of example without limitation, adjacent tubular members may be threadedly connected at corresponding end portions. A continuous bore may be defined by the tubular members and may extend for the length of the work string 100.

The lower end of the tool string 100 may include a diverter section 104. As viewed in the drawing, the diverter section 104 may be positioned near the bottom of the wellbore 102, but the diverter section 104 may be positioned at any suitable location in the wellbore 102. The diverter section 104 may be coupled to a dart landing sub 108. In certain embodiments, the diverter section 104 may be coupled to the dart landing sub 108 via a tubular member 106. In certain embodiments, such as that depicted in FIG. 1B, the work string 100 may include a float sub 105 positioned, for example, between the diverter section 104 and the dart landing sub 108. The float sub 105 may be configured to prevent backflow into the work string 100.

The dart landing sub 108 may be coupled to a rupture disk sub 110. The rupture disk sub 110 may be coupled to one or more additional rupture disk subs to form a series of rupture disk subs spaced along a portion of the tool string 100. In the non-limiting example of FIG. 1, the rupture disk sub 110 is coupled to a rupture disk sub 114 via tubular member 112, and the rupture disk sub 114 coupled to a rupture disk sub 118 via tubular member 116. Each rupture disk sub 110, 114, 118 may comprise a rupture disk assembly of one or more rupture elements that may be ruptured at a predetermined pressure level. The burst pressure ratings of the rupture disk subs may increase stepwise with a higher position in the work string 100. By way of example without limitation, the rupture disk sub 110 may have a burst rating of 2000 psi; the rupture disk sub 114 may have a burst rating of 2500 psi; and the rupture disk sub 118 may have a burst rating of 3000 psi. As will be explained in greater detail later, the series of rupture disk subs may indicate the TOC (top of cement) after a cement plug has been set in the annulus between the work string 100 and the wellbore 102, and also filling parts of the work string.

The rupture disk sub 118 may be coupled to a disconnect tool 120. The disconnect tool 120 may be coupled to a tubular section 122, which may extend to the ground surface. Although not clear from the diagram of FIG. 1, it should be understood that, in most installations, the lengths of the tool string components may be far greater than the lengths depicted; and, when the tool string components are connected as shown and described above, the tool string 100 thus formed is sufficient to span substantially the entire length of the wellbore 102 plus any additional distance to the rig (riser).

In certain embodiments, one or more of the work string components may be coupled to or comprise a centralizer to guide the work string component relative to the wellbore 102. A centralizer, as used herein, may include conventional centralizers and any device extending toward the wellbore 102 that aids in centering the tool string component to which the centralizer is coupled in any suitable manner. Therefore, when lowered into the wellbore 102 as a part of the tool string 100, the device functions to center the tool string component, and therefore the tool string 100. The diverter section 104 and the tubular member 106 may have centralizers. In the example depicted, the diverter section 104 include one or more centralizers 107 extending radially away from the diverter section 104. In certain embodiments, the centralizer 107 may include multiple flat, elastomer gaskets stacked together.

Figure 2:
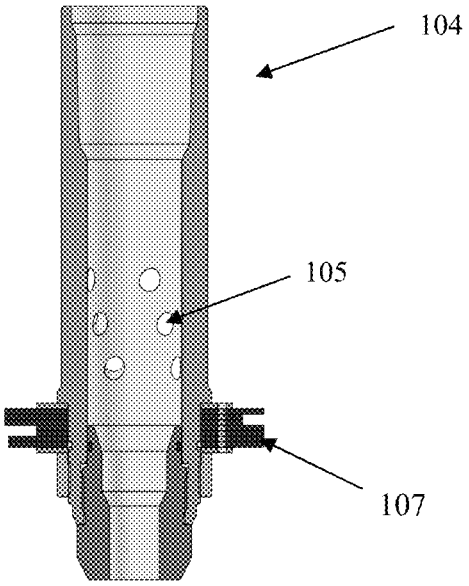
FIG. 2 illustrates one exemplary diverter section, in accordance with certain embodiments of the present disclosure.

FIG. 2 illustrates one exemplary diverter section 104, in accordance with certain embodiments of the present disclosure. The diverter section 104 may comprise a tubular housing with one or more ports 105 defined therethrough to communicate and redirect fluids received via the work string 100 to the annulus between the diverter section 104 and the wellbore 102, referring again to FIG. 1. The diverter section 104 may be configured to provide jetting action for wellbore cleaning to help ensure successful cement placement.

Figure 3A:
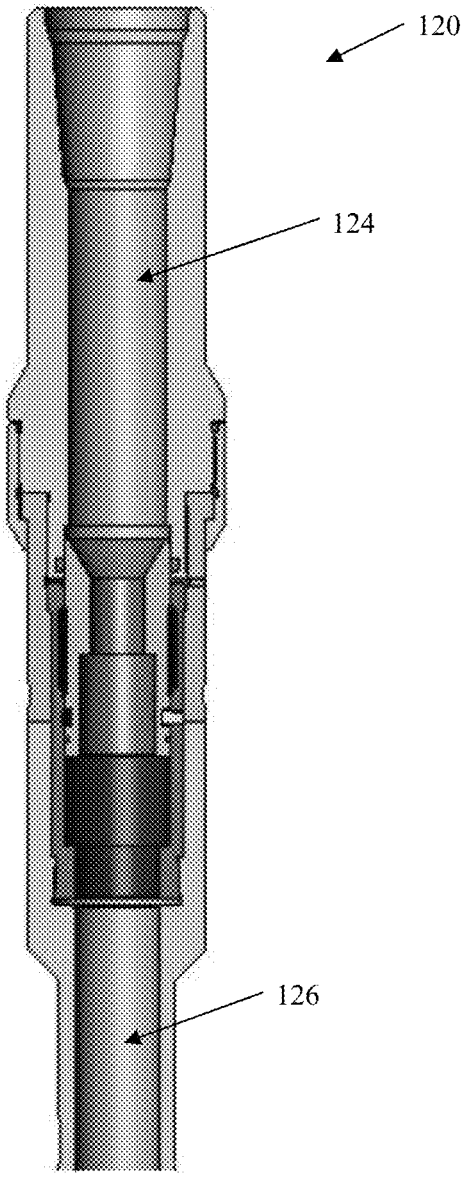
FIGS. 3A and 3B illustrate one exemplary disconnect tool, in accordance with certain embodiments of the present disclosure.
Figure 3B:
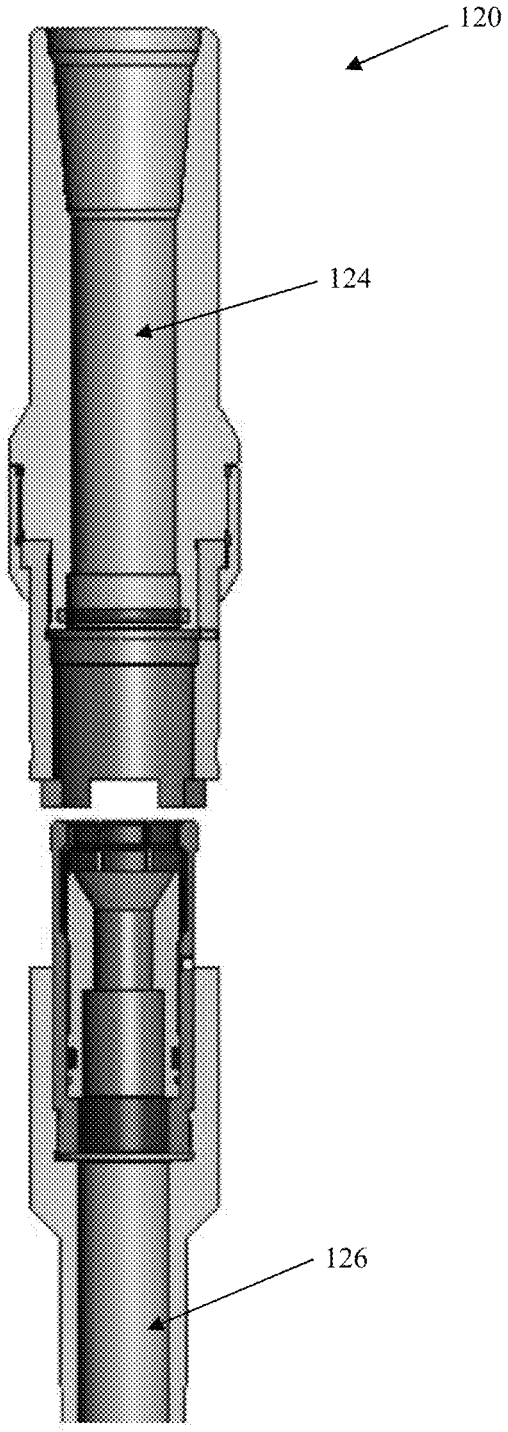

Still referring to FIG. 1, the disconnect tool 120 is well disclosed in U.S. Pat. Nos. 6,772,835 and 6,880,636, which are hereby incorporated by reference in its entirety for all purposes. Since the disconnect tool 120 is well disclosed in the above-referenced patent, the tool will only be described generally as follows. FIGS. 3A and 3B illustrate one exemplary disconnect tool 120, in accordance with certain embodiments of the present disclosure. FIG. 3A shows the disconnect tool 120 in the connected state; in FIG. 3B shows the disconnect tool 120 in the disconnected state. The disconnect tool 120 comprises an upper body member 124 that may be coupled to the tubular section 122 and a lower body member 126 that may be coupled to the rupture disk sub 118. The two body members are quick-releasably coupled together, and the upper member 124 defines a seat for receiving a flow prevention mechanism. The flow prevention mechanism may be a releasing dart or a phenolic ball. The flow prevention mechanism may be a ball valve as disclosed in U.S. Pat. No. 7,472,752, which is hereby incorporated by reference in its entirety for all purposes. The seat has a greater diameter than the ball valve so as to allow the latter ball valve to pass through the tool 120.

Referring again to FIG. 1, the work string 100 is shown assembled and lowered to a predetermined depth in the wellbore 102, so that the lower end of the diverter section 104 is disposed above the bottom of the wellbore 102. It should be understood that the diverter section 104 may be disposed at any suitable position above the bottom of the wellbore 102. If applicable, it may be desirable to tag the total depth of the wellbore 102 with the work string 100 first and then raise the work string 100 off the bottom of the well bore 102 and into position.

FIG. 1B shows the work string 100 with cement plug 128 in place, in the annulus between the tail pipe of the work string 100 and the wellbore 102, as well as inside the lower portion of the work string. In this context, the end of the work string 100 may be referred to generally as the "tail pipe." While the plug 128 is depicted as already in place, it should be understood that the diverter section 104 may be used to jet fluids for wellbore cleaning prior to the placement of the plug 128.

With the plug 128 set and cement located inside and outside the tailpipe, the work string 100 may be used to physically load test the plug 128 in the upward direction with a pull test when the cement has cured. As should be understood by one skilled in the art and having the benefit of this disclosure, the pulling force may be applied with any suitable work string lifting equipment. As a non-limiting example, a pull test may include applying a suitable pulling force (of about 30 MT, e.g.) over the dead weight of the work string 100. In this way, there is no need for physically tagging a plug with a work string by applying weight from above. Alternatively or in addition, load testing in the downward direction may be performed. Additionally, the cement plug may be pressure tested to limitation of the exposed rupture disks, either down the work string or in reverse direction or a combination of the two.

The cement plug 128 is depicted with a TOC (top of cement) 130 as a non-limiting example. The TOC 130 is above rupture subs 110 and 114, but below rupture sub 118. A lower TOC limit 132 represents what may be one potential lower limit for a TOC. An upper TOC limit 134 represents what may be one potential upper limit for a TOC. The span between the lower TOC 132 limit and the upper TOC limit 134 may be one potential range of the planned extent of the cement plug. It should be understood that many variations may implemented in view of the present disclosure.

The series of rupture subs 110, 114, 118 may allow for determination of the location of TOC 130 in relation to the rupture disks which may have known locations in the wellbore 102. The pressure at which circulation is established at will indicate which rupture sub has been burst, since the burst pressure rating will increase stepwise going upwards in the string. In the non-limiting example depicted, the lowest rupture sub 110 may be designed with a burst rating of 2000 psi, and fluid in the work string 100 or annulus may be pressurized to burst the rupture sub 110. However, because the plug 128 extends above the rupture sub 110, circulation cannot be established. When fluid pressure is increased corresponding to the burst rating of the next rupture sub 114, which may be rated for 2500 psi, circulation likewise cannot be established due to the extent of the plug 128. But, when fluid pressure is increased corresponding to the burst rating of the uppermost rupture sub 118, which may be rated for 3000 psi, the rupture sub 118 may be ruptured and circulation through the work string 100 and up the annulus or in reverse direction may be established. This process would indicate that the TOC 130 is between the uppermost rupture sub 118 and the middle rupture sub 114, based on the known ratings of the subs and the applied fluid pressures. With the known locations of the work string 100 and the rupture subs 114, 118, the TOC 130 can be determined. In view of this example, it should be appreciated that many variations may be implemented, including implementing any number of rupture subs and/or elements in any desired positions to employ the principles of this disclosure.

Figure 4A:
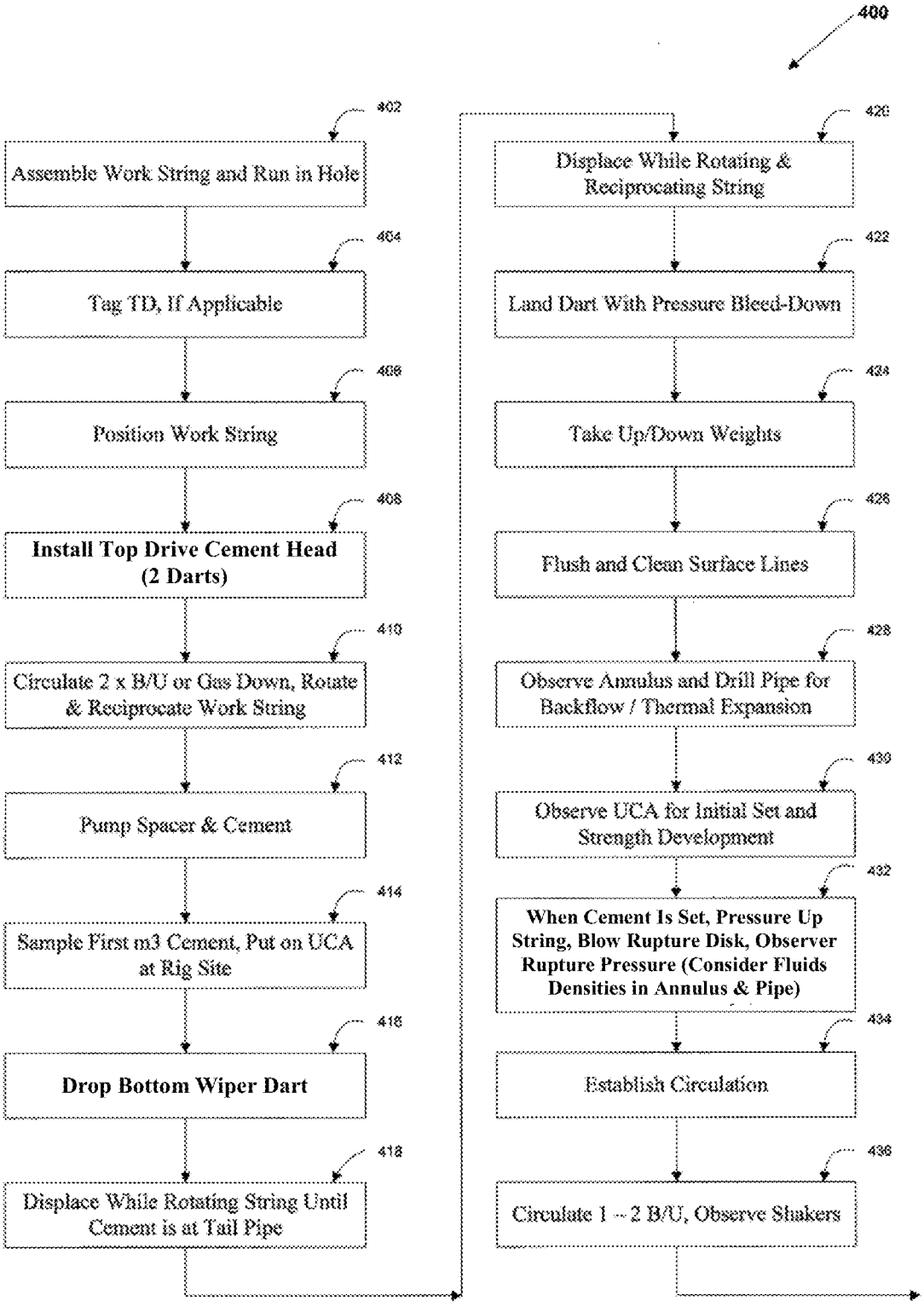
FIGS. 4A and 4B depict a flow diagram for an example method, in accordance with certain exemplary embodiments of the present disclosure.
Figure 4B:
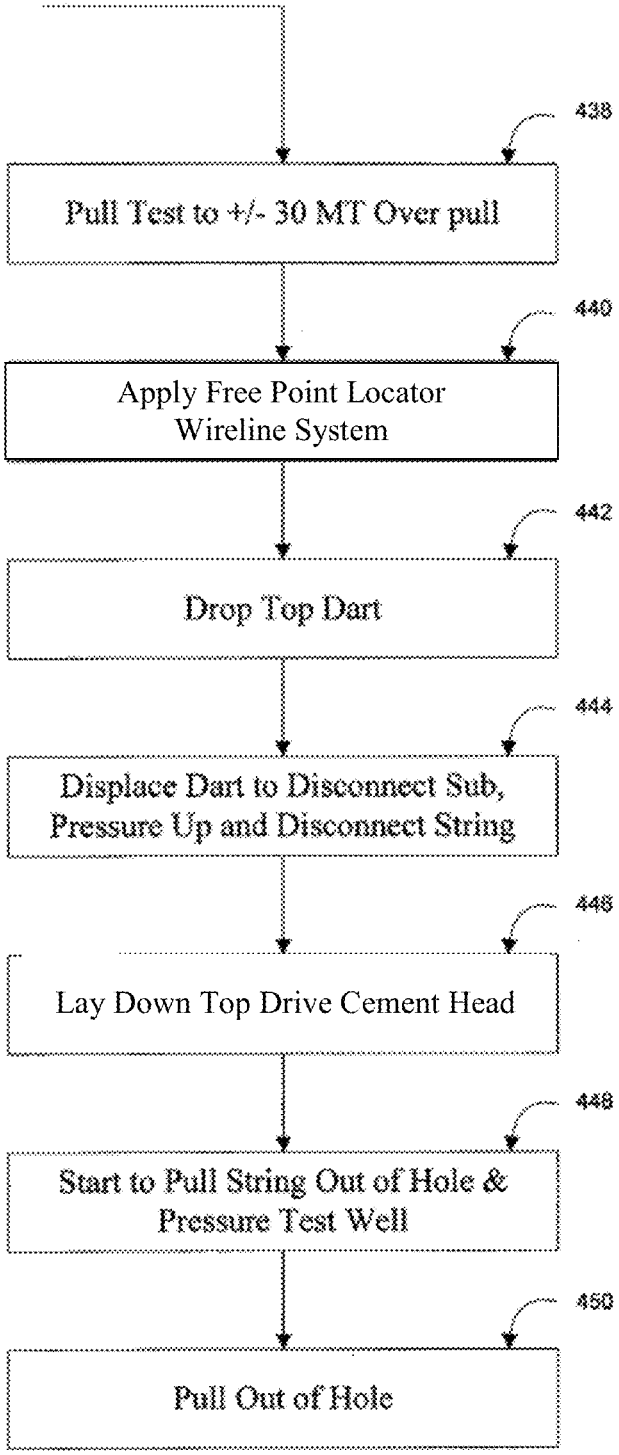

FIGS. 4A and 4B depict a flow diagram for an example method 400, in accordance with certain exemplary embodiments of the present disclosure. Teachings of the present disclosure may be utilized in a variety of implementations. As such, the order, combination, and/or performance of the steps comprising the method 400 may depend on the implementation chosen.

According to one example, the method 400 may begin at step 402. At step 402, the work string 100 may be assembled and run in hole. At step 404, if applicable, the total depth (TD) of the wellbore 102 may be tagged with the work string 100. At step 406, raise the work string 100 off the bottom of the well bore 102 and into position.

At step 408, a cementing head (not shown) may be installed on a top portion of the tubular section 124. In certain exemplary embodiments, the cementing head may be a top drive cementing head configured for two darts. A wide variety of cementing heads may be suitable for use according to the present disclosure. Examples of such suitable cementing heads may be found, for example, in U.S. Pat. No. 6,517,125, the disclosure of which is incorporated herein by reference. In certain exemplary embodiments, the cementing head may comprise a plunger assembly having the capability of individually segregating multiple cementing plugs or darts. An example of such cementing head may be found, for example, in U.S. Pat. Nos. 5,236,035, and 5,293,933, the disclosures of which are incorporated herein by reference.

At step 410, circulation may be initiated in the work string 100 and the annulus. The circulation may be two times bottoms up or gas down. The work string 100 also may be rotated and reciprocated.

At step 412, a volume of fluid and a volume of cement slurry may be pumped into the work string 100. At step 414, a sample of a predetermined volume of cement, such as from the first cubic meter, may be taken for analysis. The sample may be for analysis with an Ultrasonic Cement Analyzer (UCA) to determine the time required to develop adequate strength, for example.

At step 416, a bottom dart may be dropped down the work string 100. The bottom dart may be a foam or conventional wiper dart with one or more flexible wipers that sealingly engage the interior wall of the work string 100 to ensure that the work string 100 is adequately clean and in order to reduce contamination of the cement slurry that may follow. Another fluid, such as drilling fluid, may be pumped behind the dart to maintain pressure behind the dart and push it down the work string 100. The dart may be capable of passing through the disconnect tool 120 and provide a hydraulic seal upon reaching the dart landing sub 108.

At step 418, as the cement travels down the work string 100, the cement may be displaced while rotating the work string 100 until the cement is at the tail pipe. At step 420, the cement and the bottom dart may be displaced while rotating and reciprocating string, and the cement may exit through one or more openings located at the tail pipe. At step 422, the dart may be landed in the dart landing sub 108.

At step 424, up/down weights may be taken. At step 426, surface lines may be flushed and cleaned. At step 428, the annulus and drill pipe may be observed for backflow and thermal expansion. At step 430, the cement sample that was taken for analysis with the UCA may be observed for initial set and strength development. After a determination that the cement in the wellbore 102 is set, the work string 100 may be pressurized up to a suitable pressure to blow the rupture disk(s) of the first rupture sub 110 at step 432. The rupture pressure may be observed, and the fluid densities in annulus and pipe may be considered. As discussed previously, the fluid pressure in the work string 100 may be increased in stepwise fashion until circulation is established at step 434.

With circulation established, it may be performed one or more times bottoms up, and shakers may be observed at step 436.

At step 438, a pull test of the plug 128 may be performed by, e.g., applying a suitable (e.g., about 30 MT) overpull. At step 440, a free point locator wireline system may be applied. For example, a commercially available free point locator may be used in conjunction with the present method to obtain an exact free point location and provide further accuracy in locating the TOC. At step 442, a top dart may be dropped into the work string 100, and displaced to the disconnect tool 120. At step 444, with suitable pressure applied from the behind to displace the dart, the dart may activate the disconnect tool 120 to disconnect the tail pipe from the work string 100. Complete details of this disconnect tool 120 and disconnect operation are provided in U.S. Pat. No. 6,772,835.

At step 446, the top drive cement head may be detached. At step 448, pull-out of the work string 100 may be initiated, and the well may be pressure-tested. At step 450, the work string 100 may be pulled out of the wellbore 102, leaving the tail pipe in the plug 128. The tail pipe, which includes sections below the disconnect tool 120, is therefore considered sacrificial.

With a conventional operational method, the rig would have to wait on the cement to set (WOC), and then use the string to tag the hard cement to verify that it is actually present and to verify the TOC. This WOC time can be substantial, as the operation duration during a normal job may require, for example, a cement fluid time in the range of 4-6 hours, which may translate to a WOC time of 12-24 hours. However, with certain embodiments according to the present disclosure, an example of program job time may be less than 1½-2 hours, with corresponding WOC time 4-6 hours. Additional job preparation time may not exceed 1 hour. Therefore, certain embodiments can offer substantial time saving during plug and abandonment operations, which as an example may be in the range 8-18 hours for one plug. If multiple plugs are eliminated, each plug elimination may add another 8-24 hours to the saved rig time potential. Hence, if a 3-plug program is replaced by this process a rig time potential of approximately 16-20 hours may be expected. It should be understood that the above examples are not provided by way of limitation.

Accordingly, certain embodiments according to the present disclosure may allow for significant time savings, as compared to conventional operations, by eliminating the need for physically tagging a plug with a work string by applying weight from above. Certain embodiments provide for the use of the string to physically load test the plug in the upward direction with a pull test. Alternatively or in addition, load testing in the downward direction may be performed. Certain embodiments allow for optimized means of determining a plug TOC (top of cement) after the plug has been set in a wellbore.

Even though the figures depict embodiments of the present disclosure in a particular orientation, it should be understood by those skilled in the art that embodiments of the present disclosure are well suited for use in a variety of orientations. Accordingly, it should be understood by those skilled in the art that the use of directional terms such as above, below, upper, lower, upward, downward, higher, lower, and the like are used in relation to the illustrative embodiments as they are depicted in the figures, the upward direction being toward the top of the corresponding figure and the downward direction being toward the bottom of the corresponding figure.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are each defined herein to mean one or more than one of the element that the article introduces.

What is claimed is:

1. A method of forming a plug in a wellbore, the method comprising:

disposing a work string in a wellbore, the work string comprising a first tool comprising a port providing fluid communication between an interior space of the first tool to an exterior space to permit placement of the plug in a wellbore;

introducing a first fluid volume via the work string to form a plug in the wellbore; and load testing the plug at least in part by applying an axial force on the plug with the work string to determine that the plug is set;

wherein the work string comprises a rupture element assembly, wherein the rupture element assembly comprises:

a first rupture element configured to rupture at a first predetermined pressure, wherein the first rupture element establishes circulation if the plug has not formed at a position corresponding to the first rupture element, and wherein the first rupture element does not establish circulation if the plug is formed at the position corresponding to the first rupture element; and a second rupture element configured to rupture at a second predetermined pressure, wherein the second rupture element establishes circulation if the plug has not formed at a position corresponding to the second rupture element, and wherein the second rupture element does not establish circulation if the plug is formed at a position corresponding to the second rupture element;

wherein the first and second rupture elements are disposed in axially spaced relation; and wherein the rupture element assembly is configured to indicate an upper extent of the plug in the wellbore, the method further comprising:

pressurizing a second fluid volume in the work string to determine the upper extent of the plug based, at least in part, on the pressure at which circulation is established.

2. The method of claim 1, wherein the axial force comprises a pulling force.

3. The method of claim 2, further comprising:

determining a location of the plug based, at least in part, on the pulling force and a distance of travel of the work string.

4. The method of claim 1, wherein the work string comprises a first tubular section, the method further comprising:

decoupling the first tubular section and the plug.

5. The method of claim 4, wherein the work string comprises a disconnect tool coupling the first tubular section to the first tool so that the first tubular section and the first tool are in fluid communication via the disconnect tool, wherein the disconnect tool is configured to allow selective decoupling of the first tubular section and the first tool, and wherein the step of decoupling the first tubular section and the plug comprises:

decoupling the first tubular section and the first tool.

6. The method of claim 5, wherein the disconnect tool comprises a dart-operated tool, the step of decoupling the first tubular section and the first tool comprising:

displacing a dart through at least a portion of the work string to initiate decoupling of the first tubular section and the first tool.

7. The method of claim 5, wherein the disconnect tool comprises a ball-operated tool, the step of decoupling the first tubular section and the first tool comprising:

displacing a ball through at least a portion of the work string to initiate decoupling of the first tubular section and the first tool.

8. The method of claim 1, wherein the step of the pressurizing the second fluid volume comprises:

pressurizing the second fluid volume in the work string incrementally until circulation between the work string and the wellbore is established.

9. The method of claim 1, wherein the axial force is directed down the wellbore.

10. An apparatus to form a plug in a wellbore, the apparatus comprising:

a work string comprising:

a first tubular section;

a disconnect tool coupling the first tubular section to a first tool so that the first tubular section and the first tool are in fluid communication via the disconnect tool, wherein the disconnect tool is configured to allow selective decoupling of the first tubular section and the first tool, wherein the first tool comprises a port providing fluid communication between an interior space of the first tool to an exterior space to permit placement of the plug in a wellbore; and a rupture element assembly configured to indicate an upper extent of the plug in the wellbore, wherein the rupture element assembly comprises:

a first rupture element configured to rupture at a first predetermined pressure, wherein the first rupture element establishes circulation if the plug has not formed at a position corresponding to the first rupture element, and wherein the first rupture element does not establish circulation if the plug is formed at the position corresponding to the first rupture element; and a second rupture element configured to rupture at a second predetermined pressure, wherein the second rupture element establishes circulation if the plug has not formed at a position corresponding to the second rupture element, and wherein the second rupture element does not establish circulation if the plug is formed at a position corresponding to the second rupture element;

wherein the first and second rupture elements are disposed in axially spaced relation;

wherein the upper extent of the plug is determined based, at least in part, on the pressure at which circulation is established, and wherein the work string is configured to permit load testing the plug at least in part by applying an axial force on the plug with the work string to determine that the plug is set.

11. The apparatus of claim 10, wherein the first tool further comprises:

a diverter section to permit jetting of a first fluid volume from the first tool.

12. The apparatus of claim 10, wherein the disconnect tool comprises a dart-operated tool configured to decouple the first tubular section and the first tool based, at least in part, on a dart displacement through at least a portion of the work string.

13. The apparatus of claim 10, wherein the disconnect tool comprises a ball-operated tool configured to decouple the first tubular section and the first tool based, at least in part, on a ball displacement through at least a portion of the work string.

14. The apparatus of claim 10, wherein the axial force comprises a pulling force.

15. The apparatus of claim 10, wherein the axial force is directed down the wellbore.

* * * * *